United States Patent [19]

Rausch

[11] Patent Number: 4,735,509

[45] Date of Patent: Apr. 5, 1988

[54] GROUT MIXING AND DISPENSING SYSTEM AND METHOD

[75] Inventor: Paul G. Rausch, Lexington, Ky.

[73] Assignee: Celtite, Inc., Georgetown, Ky.

[21] Appl. No.: 908,549

[22] Filed: Sep. 18, 1986

[51] Int. Cl.[4] ..... B01F 7/00

[52] U.S. Cl. ..... 366/333; 366/129; 366/184; 366/258

[58] Field of Search ..... 206/219, 222, 384, 497; 222/137, 145; 210/257.1; 366/330, 332, 333, 335, 256, 258, 279, 129, 184, 194, 195, 196, 189

[56] References Cited

U.S. PATENT DOCUMENTS

| | | | |
|---|---|---|---|
| 1,417,707 | 5/1922 | Wright | 206/384 |
| 3,043,424 | 7/1962 | Howard | 206/219 |
| 3,197,067 | 7/1965 | Rataczak | 366/333 |
| 3,730,394 | 5/1973 | Woodson | 366/130 |
| 3,735,900 | 5/1973 | Gores | 366/129 |
| 3,858,853 | 1/1975 | Rausch et al. | 366/279 |
| 3,861,522 | 1/1975 | Llewellyn et al. | 206/219 |
| 4,227,612 | 10/1980 | Dillon | 206/219 |
| 4,353,463 | 10/1982 | Seemann | 206/222 |
| 4,371,094 | 2/1983 | Hutter, III | 366/333 |

*Primary Examiner*—Robert W. Jenkins

*Attorney, Agent, or Firm*—Caesar, Rivise, Bernstein, Cohen & Pokotilow, Ltd.

[57] ABSTRACT

A system and method for mixing and dispensing grout to be used for anchoring of bolts or bars in the floors, walls or ceilings of structures or excavations is disclosed. The system comprises a caulking tube in which grout components, a catalyst and a mastic, have been placed inside a plastic bag along with an assembly for mixing the grout and a mixing rod. When the grout is ready to be used the dispensing tip of the caulking tube is cut off and the mixing rod is inserted through the opening in the tip and into a slot cut in a wall of the mixing assembly. The other end of the mixing rod is formed so that it may be inserted into the chuck of a drill. When the drill is operated, the mixer assembly, upon which mixing blades have been installed, rotates and as the drill is pressed forward the mixer assembly is moved longitudinally through the tube mixing the components of the grout. The caulking tube is covered with a shrink wrap to prevent the movable end (opposite the dispensing tip) of the caulking tube from being ejected during the mixing operation. After mixing is complete, the mixing rod is removed and the caulking tube is placed in a caulking gun. When the trigger of the gun is pulled, the plunger of the gun presses against the movable end and grout is ejected from the dispensing tip.

11 Claims, 2 Drawing Sheets

GROUT MIXING AND DISPENSING SYSTEM AND METHOD

BACKGROUND OF THE INVENTION

This invention relates generally to the mixing and dispensing of grout, and more particularly to a system and method for mixing and dispensing grout.

For the anchoring of bolts or deformed bars in the floors, walls or ceilings of structures or excavations, or in concrete or cement floorings, grout is used. Grouts are self setting mixtures which have a gel time followed by a cure time. The grout compositions have interactive ingredients, a catalyst and mastic, which are often stored separately and mixed together in precise quantities on site. After mixing, the grout must be applied to the hole holding the bolt or bar before the grout gels and sets. However, the mixing of precise quantities of the grout ingredients on site is wasteful and uneconomical.

As is known to those familiar with the art, grout compositions can comprise polyester resins, epoxy resins or inorganic material such as cementitious resisns.

A cartridge for holding grout with two unmixed interactive components and method for of making same is disclosed in U.S. Pat. No. 3,915,297 by the present inventor.

U. S. Pat. No. 3,858,853, also by the present inventor discloses a container with a mixer and a method of use. A hollow caulking tube, with the grout material, catalyst and mastic, inside, is used. The catalyst and mastic material are in contact longitudinally throughout the tube. Where contact has taken place a slight chemical reaction occurs which prevents further reaction between the two components.

In U.S. Pat. No. 3,858,853, one end of the tube is removable (the end opposite the dispensing end of the tube). Such end is removed, and a mixing rod is placed through a hole in the end, and connected to a mixer blade. The removable end is placed back on the tube with the mixer blade inside. The other end of the mixing rod is placed in the chuck of a drill. When the drill is operated, the mixer blade rotates and is urged forward through the composition within the tube so that the contents of the tube are mixed. At the conclusion of the procedure the mixer blade is at the front or dispensing end of the caulking tube and the rod is removed. The hole in the removable end is covered with a piece of tape, and grouting may now be applied for the anchoring of bolts or bars.

Although the existing apparatus and method performs the function of mixing the grouting components prior to use of the grout for anchoring, it has certain limitations. The grout components within the container, the catalyst and mastic, tend to leak and the grout tends to deteriorate with time thereby reducing its shelf life. Also, after completion of the mixing process, the mixer blade is positioned at the dispensing end of the container which tends to impede the flow of the grout out of the container. Finally the tube must be opened by removing its end opposite the dispensing tip and placing the mixer blade within the tube. The end must then be placed back onto the tube prior to mixing.

OBJECTS OF THE INVENTION

It is the general object of the instant invention to provide a system and method for the mixing and dispensing of grout which overcomes disadvantages of prior apparatus and methods.

It is another object of the instant invention to provide a grout mixing and dispensing system which does not suffer from leakage during storage.

It is yet another object of this invention to provide a rapid and easy method for mixing and dispensing grout which does not require removal and reassembly of the components of the system.

It is still yet another object of the invention to provide a grout mixing and dispensing system with an extended shelf life.

It is a further object of the instant invention to provide a grout mixing and dispensing system and method wherein the mixer blades of the system are located at the end of the system which is opposite the dispensing end after mixing so that the flow of grout is not impeded when the grout is dispensed for anchoring.

It is yet another object of this invention to provide a grout mixing and dispensing system wherein the mixer blades of the system are assembled within the tube thereby eliminating the need to place the mixer blades within the tube prior to mixing.

SUMMARY OF THE INVENTION

These and other objects of the instant invention are achieved by providing an assemblage which includes a hollow caulking tube into which a cartridge has been placed. The cartridge is a plastic bag with a catalyst and a mastic material inside, which are separated in the cartridge and are not mixed. Also within the caulking tube, at the dispensing end of the tube, is a mixing assembly with a sloted rear wall. A mixing rod is also included with the system.

To mix and dispense the grouting, the tip of the dispensing end is first cut off and the mixing rod inserted through the tip. One end of the mixing rod is shaped to fit into the slot in the mixer assembly. The other end of the mixing rod is shaped to fit the chuck of a drill. Thus when the drill is operated and the mixing assembly is urged forward, the mixer blades mix the grout components. In addition, the blades cut the plastic bag which holds the grout material. Upon completion of the mixing operation, the mixer assembly is located at the far end (the end opposite the dispensing end) of the caulking tube.

The end opposite the dispensing end is movable since it is urged forward by a caulking gun when the grout is dispensed. A shrink wrap is used to enclose the caulking tube, which secures the movable end during the mixing operation.

After the mixing operation is completed and the mixer rod is removed, the caulking tube is placed into a caulking gun for dispensing of the grout material.

This invention will be readily appreciated as the same becomes better understood by reference to the following detailed description when considered in connection with the accompanying drawing wherein:

DETAILED DESCRIPTION OF THE PREFERRED EMBODIMENT

Figure 1:
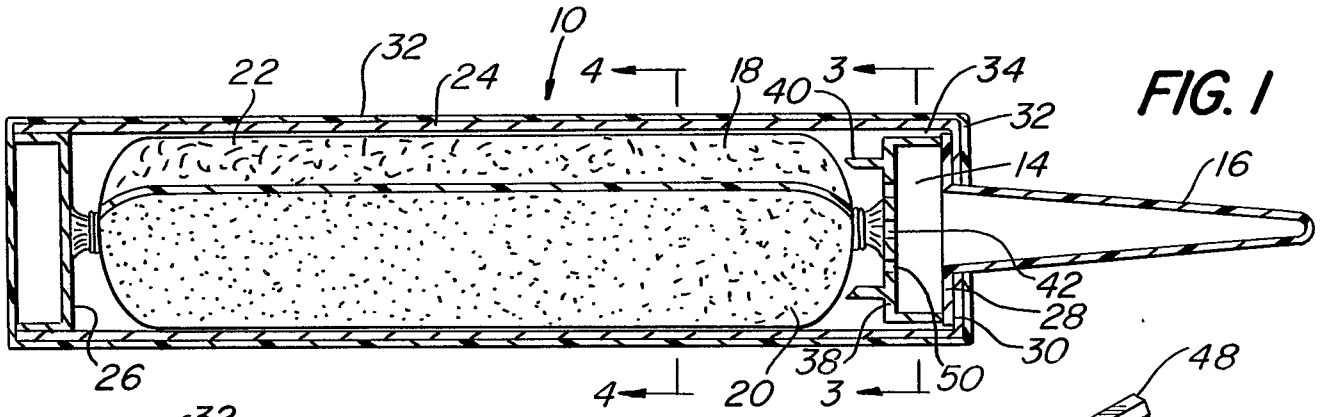
FIG. 1 is a side elevational view, in section, of the caulking tube with the grout cartridge and mixer assembly in place therein.

Referring now in greater detail to the various figures of the drawing, wherein like reference characters refer to like parts, there is shown in FIG. 1 a side elevational view, in section, of the assembled caulking tube 10 of the grout dispensing system. Placed within the tube is grout cartridge 12 and mixer assembly 14 which is located near dispensing tip 16.

Within cartridge 12 are catalyst material 18 and mastic material 20 which are enclosed in a plastic bag 22. The plastic bag 22 prevents leakage of the grout components, the catalyst material 18 and mastic material 20, and protects the grout, which extends its shelf life.

Caulking tube 10 is a standard tube with a cardboard cylindrical side wall 24, movable end wall 26 and dispensing tip 16. The base 28 of dispensing tip 16 abuts the inner surface of front wall 30 which is attached to side wall 24. Dispensing tip 16 projects through an opening in front wall 30. To secure the movable end wall 26 during the mixing operation, as will be explained later, caulking tube 10 is encased in shrink wrap 32.

Mixer assembly 14 comprises cylindrical side wall 34 and rear wall 38 upon which are mounted mixing blades 40. A slot 42 is cut into the surface of rear wall 38 to receive one end of the mixing rod 44 as is explained below.

Figure 2:
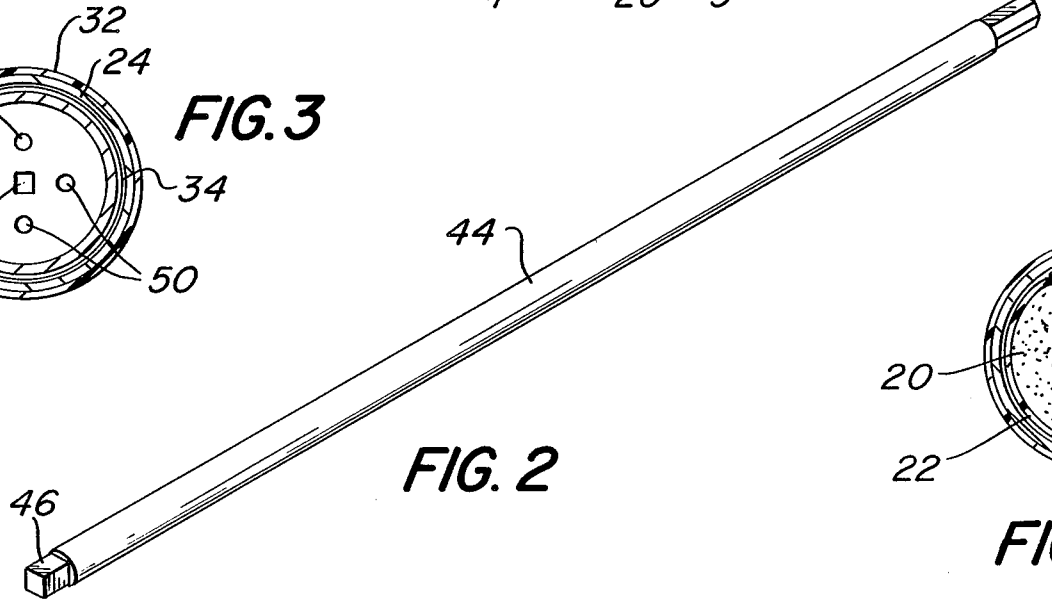
FIG. 2 is a isometric view of the mixing rod of the system.

A perspective view of the mixing rod 44 is shown in FIG. 2. The front end 46 of mixing rod 44 is rectangularly shaped to fit into slot 42 in rear wall 38 of mixer assembly 14. The rear end 48 of mixing rod is hexagonally shaped so that it may fit into the chuck of a standard drill as will be explained later. Alternatively, rear end 48 may be triangular in shape and front end 46 and slot 42 may be narrow in shape (similar to a screw driver end).

Figure 3:
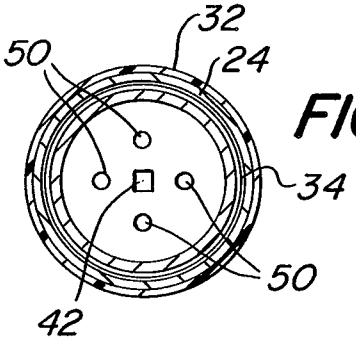
FIG. 3 is across sectional view of the mixer assembly within the caulking tube taken along the line 3—3 of FIG. 1.

The mixer assembly 14 in place within caulking tube 10 is shown in cross section in FIG. 3. Flow through holes 50 allow the grout to flow through the mixer assembly during the mixing operation to reduce back pressure as will be explained later. Alternatively, relief slots may be cut in cylindrical side wall 32, to allow for grout flow through during mixing instead of using holes 50.

Figure 4:
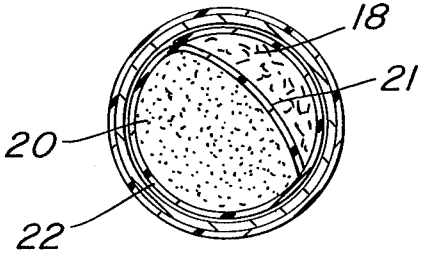
FIG. 4 is a cross sectional view of the grout cartridge within the caulking tube taken along the line 4—4 of FIG. 1.

FIG. 4 shows the cartridge in place within the caulking tube in cross section along the line 4—4 of FIG. 1. Within plastic bag 22 are catalyst 18 and mastic 20. A plastic barrier 21 is placed between catalyst 18 and mastic 20 to prevert contact prior to mixing.

Figure 5:
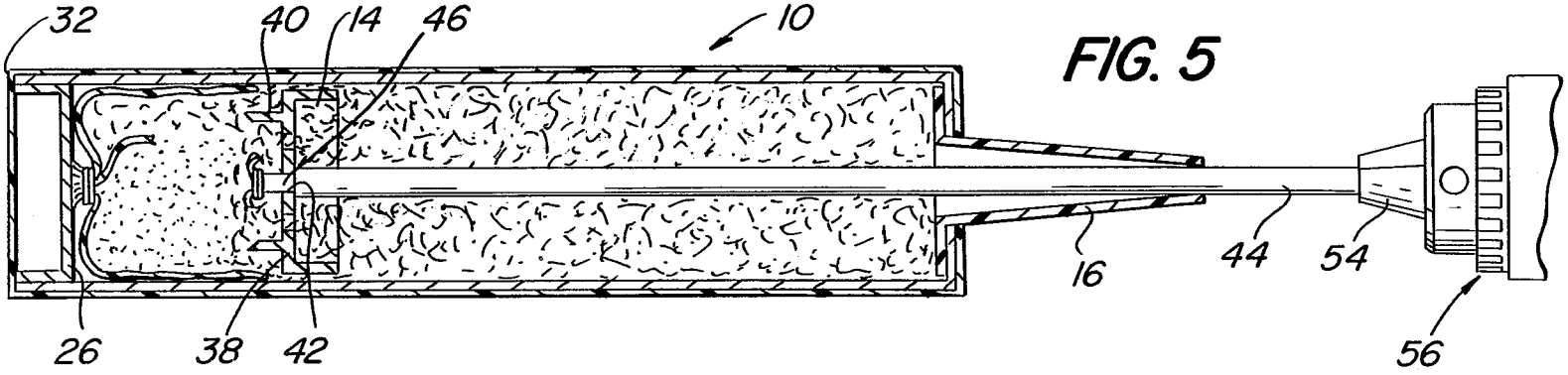
FIG. 5 is a side elevational view, in section, showing the positioning of the mixer assembly and its connection to the mixing rod during the mixing operation.

FIG. 5 is a side elevational view, in section, of the caulking tube 10 illustrating the positioning of the mixer assembly 14 and mixing rod 44 during the mixing operation. As shown in FIG. 5 front end 46 of mixing rod 44 is placed within slot 42 in rear wall 38 of mixer assembly 14. The rear end 48 of mixing rod 44 is placed within the chuck 54 of drill 56. Rod 44 is inserted through a hole formed in tip 16 when the end of tip 16 is cut off.

After emplacement of front end 46 of the mixing rod 44 in slot 42, the drill is operated causing the mixer assembly 14 to rotate. Forward pressure is applied on drill to urge mixer assembly 14 forward as it rotates, so that the catalyst and mastic will be mixed along the longitudinal length of caulking tube. Here it should be noted that there is pressure on movable end wall 26 to eject it from the caulking tube 10. However, the shrink wrap 32 secures end wall 26 and holds it in place. Back pressure is relieved by holes 50 (FIG. 3) which allow grout to flow through rear wall 58 when mixer assembly 14 is urged forward through caulking tube 10.

When mixer assembly 14 has progressed until the mixing blades 40 abut the inner surface of end wall 26, drill 56 is stopped and mixing rod 44 is removed from slot 42 and from the interior of caulking tube 10 through the hole in tip 16.

Figure 6:
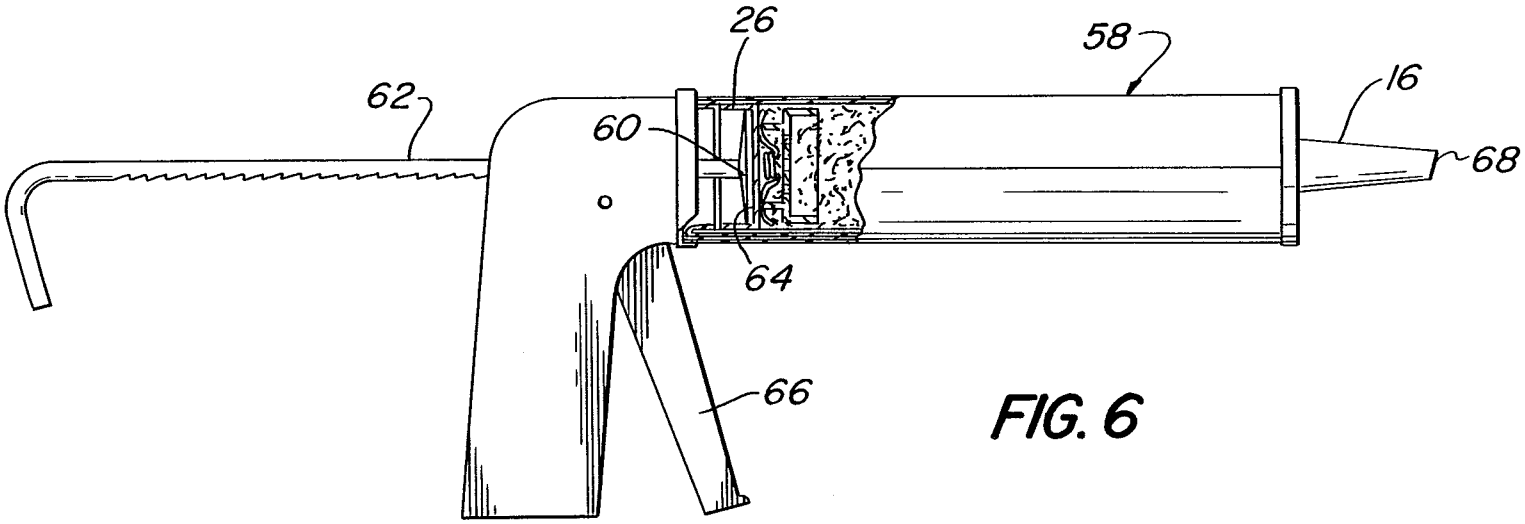
FIG. 6 is a side elevational view, partly in section, of the caulking gun with the caulking tube in place therein for the dispensing of the grout.

The grout is now ready for dispensing and to be used to anchor bolts and bars in structure members and flooring. FIG. 6 shows how the grout is dispensed by installing the caulking tube 10 into caulking gun 58 of conventional construction. Plate 60 of plunger 62 abuts inner surface 64 of movable end wall 26. When trigger 66 is depressed, plunger 62 presses forward causing movable end wall 26 to move toward dispensing tip 16, thereby causing grout to be ejected through hole 68 which was created when the end of dispensing tip 16 was cut off.

Thus, as can be seen by the aforementioned description, a system and method for the mixing and dispensing of grout has been shown which has an extended shelf life and which prevents leakage of the grout components. The system may easily and rapidly be used without disassembly and reassembly of any parts. The flow of grout through the dispensing tip is unimpeded and occurs smoothly and easily.

Without further elaboration, the foregoing so fully illustrates the invention that others may, by applying current or future knowledge, readily adapt the same for use under various conditions of service.

I claim:

1. A grout mixing and dispensing system comprising a hollow caulking tube with a forwardly extending dispensing tip, said tube also having a rearwardly disposed but forwardly moveable end wall, a cartridge and a mixer assembly placed and maintained within said tube, said cartridge comprising a plastic bag holding grout, with said grout comprising a catalyst and a mastic material which are unmixed, and a mixing rod comprising a first and a second end, with said first end shaped to be engaged with said mixer assembly through said tip when said tip is cut open and said second end shaped to be engaged with the chuck of a drill, whereby action of the drill advances said mixer assembly in a mixing action away from said dispensing tip and wherein a caulking gun is used upon completion of the mixing action to urge said caulking tube moveable end wall forwardly to carry with it said mixer assembly while dispensing the mixed catalyst and mastic material through said dispensing tip.

2. The system of claim 1 wherein said mixer assembly comprises a cylinderical side wall and a rear wall connected to said side wall and having a slot and wherein said first end of said mixing rod is shaped to be engaged with said slot.

3. The system of claim 2 wherein said mixer assembly further comprises blades installed in said rear wall for mixing said catalyst and said mastic and for cutting said plastic bag, when said first end of said rod is fitted into said slot and said second end of said rod is fitted into said chuck and said drill is operated.

4. The system of claim 3 wherein said caulking tube further comprises a movable end wall and a shrink wrap film to secure said end wall when said drill is operated and said grout is mixed.

5. The system of claim 4 wherein said rear wall has holes through which said grout may flow when it is mixed.

6. The system of claim 5 wherein said cylindrical side wall comprises relieved portions through which said grout may flow when it is mixed.

7. The system of claim 1 wherein said grout comprises a polyester resin.

8. The system of claim 1 wherein said grout comprises an epoxy resin.

9. The system of claim 1 wherein said grout comprises a cementitious mixture.

10. A method for mixing and dispensing grout comprising the steps of cutting the tip at the dispensing end of a caulking tube, said tube containing a cartridge with grout comprising a catalyst and mastic material which are unmixed in a plastic bag, and a mixer assembly positioned near said dispensing end, inserting a mixing rod, having first and second ends, through the cut tip of said dispensing end of said caulking tube, engaging the first end of said mixing rod with said mixer assembly and engaging the second end of said mixing rod into the chuck of a drill, operating said drill to rotate said mixer assembly, urging said mixer assembly forward longitudally into said cartridge until said grouting is mixed, and said mixer assembly is at the end of said tube opposite said dispensing end, stopping said drill and removing said rod through said cut tip of said tube, placing said tube into a caulking gun and operating said gun to urge said grouting out through said dispensing end.

11. The method of claim 10 wherein mixer assembly comprises a cyliderical side wall and a rear wall, connected to said side wall, and having a slot and wherein said first end of said mixing rod is engaged with said slot.

* * * * *